US008489393B2

(12) United States Patent
Alves et al.

(10) Patent No.: US 8,489,393 B2
(45) Date of Patent: Jul. 16, 2013

(54) SPEECH INTELLIGIBILITY

(75) Inventors: Rogerio Guedes Alves, Macomb, MI (US); Kuan-chieh Yen, Northville, MI (US); Michael Christopher Vartanian, Commerce Township, MI (US); Sameer Arun Gadre, Northville, MI (US)

(73) Assignee: Cambridge Silicon Radio Limited, Cambridge (GB)

( * ) Notice: Subject to any disclaimer, the term of this patent is extended or adjusted under 35 U.S.C. 154(b) by 867 days.

(21) Appl. No.: 12/623,896

(22) Filed: Nov. 23, 2009

(65) Prior Publication Data

US 2011/0125492 A1 May 26, 2011

(51) Int. Cl.
*G10L 19/00* (2006.01)

(52) U.S. Cl.
USPC ..... 704/219; 704/223; 375/243

(58) Field of Classification Search
USPC ..... 704/219, 223; 375/243
See application file for complete search history.

(56) References Cited

U.S. PATENT DOCUMENTS

| | | | | |
|---|---|---|---|---|
| 6,993,480 | B1 | 1/2006 | Klayman | |
| 7,461,003 | B1 * | 12/2008 | Tanrikulu | 704/500 |
| 8,260,611 | B2 * | 9/2012 | Vos et al. | 704/223 |
| 2004/0111257 | A1 * | 6/2004 | Sung et al. | 704/219 |

OTHER PUBLICATIONS

Thomas, I. B., "The Influence of First and Second Formants on the Intelligibility of Clipped Speech," Journal of the Audio Engineering Society, vol. 6, No. 2, pp. 182-185, Apr. 1968.
American National Standards Institute, "Methods for Calculation of the Speech Intelligibility Index," ANSI S3.5, 1997.
Chanda, P.S. et al., "Speech Intelligibility Enhancement Using Tuneable Equalization Filter," IEEE International Conference on Acoustics, Speech, and Signal Processing (ICASSP), 2007.
Yasukawa, H., "Quality Enhancement of Band Limited Speech by Filtering and Multirate Techniques," Proceedings of International Conference on Speech Language Processing, 1994.
Park, K.Y. et al., "Narrowband to Wideband Conversion of Speech Using GMM Based Transformation," Proceedings of IEEE Int'l. Conference on Acoustics, Speech, and Signal Processing (ICASSP) 2000.
Nilsson, M. et al., "Avoiding Over-Estimation in Bandwidth Extension of Telephony Speech," Proceedings of IEEE Int'l. Conference on Acoustics, Speech, and Signal Processing (ICASSP) 2001.

(Continued)

*Primary Examiner* — Daniel D Abebe
(74) *Attorney, Agent, or Firm* — Frommer Lawrence & Haug LLP; John W. Branch

(57) ABSTRACT

The perceived quality of a narrowband speech signal truncated from a wideband speech signal is improved by generating in a third frequency band third speech components matching first speech components in a first frequency band of the narrowband signal, and generating in a fourth frequency band fourth speech components matching second speech components in a second frequency band of the narrowband signal. A first gain factor is applied to the third speech components to generate adjusted third speech components, and a second gain factor is applied to the fourth speech components to generate adjusted fourth speech components, the gain factors being selected such that the ratios of the average powers of the adjusted third and fourth speech components to the average power of the first speech components are predetermined values.

17 Claims, 7 Drawing Sheets

OTHER PUBLICATIONS

Vartanian, M.,"NDVC—Noise Dependent Volume Control Development," Cambridge Silicon Radio Limited Internal Report, Feb. 2006.

Rittmueller, S. et al., "Dynamic Audibility Enhancement," Cambridge Silicon Radio Limited Internal Report, 2005.

Goldin, A.A. et al., "Automatic Volume and Equalization Control in Mobile Devices," 121st Audio Engineering Society Convention, 2006.

Sauert, B., et al., "Near End Listening Enhancement Speech Intelligibility Improvement in Noisy Environments," Proceedings of IEEE Int'l. Conference on Acoustics, Speech, and Signal Processing (ICASSP) 2006.

* cited by examiner

Sound levels

| Type of sound | Level | Known Weighting |
|---|---|---|
| Maximum theoretical level (linear acoustics) of an acoustic sine wave with a peak amplitude of 101, 325 Pa (Atmospheric pressure at sea level) | 211 | dB |
| Human eardrums rupture 50% of time | 190-195 | dB |
| Rock concert speaker sound | 120 | dB |
| Heavy metal, hard rock band music | 110 | dB |
| Normal average car or house stereo at maximum volume | 100 | dB |
| Headphones - High levels | 95 | dB |
| Airplane cabin at normal flight | 90 | dB |
| The source of this babble is 100 people speaking in a canteen. The room radius is over two meters | 88 | dB(A) |
| Beginning of hearing damage, earplugs should be worn | 85 | dB |
| Headphones - Average | 82 | dB |
| Loud - Intolerable for phone use | 80 | dB |
| Inside automobile | 70 | dB |
| Restaurant | 70 | dB |
| Average office | 60 | dB |
| Quiet office | 50 | dB |
| Average home | 50 | dB |

FIG. 5

SPEECH INTELLIGIBILITY

FIELD OF THE INVENTION

This invention relates to improving the perceived quality of a speech signal, and in particular to reducing the algorithmic complexity associated with such an improvement.

BACKGROUND OF THE INVENTION

Mobile communications are subject to adverse ambient noise conditions. A user listening to a signal received over a communication channel perceives the quality of the signal as being degraded as a result of the ambient noise at both the transmitting end of the communication channel (far-end) and the ambient noise at the user's receiving end of the communication channel (near-end).

The problem of far-end ambient noise has been extensively addressed through the application of noise reduction algorithms to signals prior to their transmission over a communication channel. These algorithms generally lead to far-end ambient noise being well compensated for in signals received at a user apparatus, such that the fact that a far-end user may be located in a noisy environment does not significantly disrupt a near-end user's listening experience.

The problem of near-end ambient noise has been less well addressed. Near-end ambient noise often has the effect of masking a speech signal such that the speech signal is not intelligible to the near-end listener. The conventional method of improving the intelligibility of speech in such a situation is to apply an equal gain across all frequencies of the received speech signal to increase its total power. However, increasing the power across all frequencies can cause discomfort and listening fatigue to the listener. Additionally, the digital dynamic range of the signal processor in the user apparatus limits the amplification that can be applied to the signal, with the result that clipping of the signal may occur if a sufficiently high gain factor is applied.

There is therefore a need to provide a user apparatus capable of improving the perceived intelligibility of a speech signal as determined by a listener at the user apparatus when the user apparatus is located in a region of significant ambient noise.

A separate problem to that of near-end ambient noise is the problem of the narrow bandwidth of signals received over a telephony channel. Telephony channels have a limited bandwidth of 0.3 kHz to 3.4 kHz. Speech signals are truncated from their original wideband form to a narrowband form such that they can be transmitted in the available bandwidth of the telephony channel. The absence of speech in frequency bands higher than 3.4 kHz reduces the perceived quality of speech signals. Consequently, it is desirable to extend the effective bandwidth of a received narrowband speech signal to the equivalent of the original wideband signal, for example from 0 kHz up to 8 kHz.

Bandwidth extension techniques have been proposed which reconstruct wideband signals using statistical speech models. For example the Gaussian Mixture model (GMM) can be used to reconstruct a wideband spectrum envelope from a narrowband speech signal, and speech can then be generated for the wideband signal using the reconstructed spectral envelope and linear predictive coding (LPC).

Such techniques are computationally complex and are therefore undesirable for use with low-power platforms.

A further problem with bandwidth extension techniques is that they tend to over-estimate the power of the extended signal, thereby introducing undesirable artefacts in the speech signal which are audible to the listener. An approach has been suggested to control the shape of the extended signal using a confidence controlled bandwidth extension algorithm. This algorithm uses an asymmetric cost-function that penalises over-estimates of the energy in the extended band more than under-estimates. However, this technique is computationally complex and therefore undesirable for use with low-power platforms.

There is therefore a need for a low complexity bandwidth extension method.

SUMMARY OF THE INVENTION

According to a first aspect of the present invention, there is provided a method of improving the perceived quality of a narrowband speech signal truncated from a wideband speech signal, the narrowband speech signal comprising first speech components in a first frequency band and second speech components in a second frequency band, the method comprising: generating in a third frequency band third speech components matching the first speech components, and generating in a fourth frequency band fourth speech components matching the second speech components; and applying a first gain factor to the third speech components to generate adjusted third speech components, and applying a second gain factor to the fourth speech components to generate adjusted fourth speech components, the gain factors being selected such that the ratios of the average powers of the adjusted third and fourth speech components to the average power of the first speech components are predetermined values, so as to form an improved speech signal comprising the first speech components, the second speech components, the adjusted third speech components and the adjusted fourth speech components.

Suitably, the method further comprises prior to the generating step: measuring the ambient noise; and performing the generating and applying steps only if the ambient noise exceeds a threshold value, the threshold value being such that above the threshold value the ambient noise inhibits perceptual artefacts of the improved speech signal.

Suitably, the first and second frequency bands are non-overlapping with each other, and the second frequency band encompasses higher frequencies than the first frequency band.

Suitably, the third and fourth frequency bands are non-overlapping with each other and each of the third and fourth frequency bands is non-overlapping with the first frequency band and non-overlapping with the second frequency band.

Suitably, the third frequency band encompasses higher frequencies than the second frequency band, and the fourth frequency band encompasses higher frequencies than the third frequency band.

Suitably, the method further comprises dynamically adjusting the bounds of each frequency band in dependence on the pitch characteristics of the speech signal.

Suitably, the ratio of the average power of the adjusted third speech components to the average power of the first speech components is a first predetermined value of the predetermined values, and the average power of the adjusted fourth speech components to the average power of the first speech components is a second predetermined value of the predetermined values, the method comprising dynamically adjusting at least one of the first and second predetermined values in dependence on one or more criteria.

Suitably, a first criterion of the one or more criteria is the ambient noise, comprising increasing the first predetermined value in response to an increase in the ambient noise.

Suitably, a first criterion of the one or more criteria is the ambient noise, comprising increasing the second predetermined value in response to an increase in the ambient noise.

Suitably, the method further comprises outputting the improved speech signal via a user apparatus, wherein a second criterion of the one or more criteria is the volume setting used by the apparatus in outputting the improved speech signal, the method comprising increasing the first predetermined value in response to an increase in the volume setting.

Suitably, the method further comprises outputting the improved speech signal via a user apparatus, wherein a second criterion of the one or more criteria is the volume setting used by the apparatus in outputting the improved speech signal, the method comprising increasing the second predetermined value in response to an increase in the volume setting.

Suitably, the method comprises periodically adjusting the first predetermined value in dependence on the one or more criteria.

Suitable, the method comprises periodically adjusting the second predetermined value in dependence on the one or more criteria.

Suitably, the first gain factor is an attenuation factor.

Suitably, the second gain factor is an attenuation factor.

According to a second aspect of the present invention, there is provided an apparatus configured to improve the perceived quality of a narrowband speech signal truncated from a wideband speech signal, the narrowband speech signal comprising first speech components in a first frequency band and second speech components in a second frequency band, the apparatus comprising: a generation module configured to generate in a third frequency band third speech components matching the first speech components, and generate in a fourth frequency band fourth speech components matching the second speech components; and an application module configured to apply a first gain factor to the third speech components to generate adjusted third speech components, and apply a second gain factor to the fourth speech components to generate adjusted fourth speech components, the application module further configured to select the gain factors such that the ratios of the average powers of the adjusted third and fourth speech components to the average power of the first speech components would be predetermined values, so as to form an improved speech signal comprising the first speech components, the second speech components, the adjusted third speech components and the adjusted fourth speech components.

Suitably, the apparatus further comprises a noise detector configured to measure the ambient noise, wherein the generation module and the application module are configured to perform their respective generating and applying functions only if the noise detector measures the ambient noise to exceed a threshold value, the threshold value being such that above the threshold value the ambient noise inhibits perceptual artefacts of the improved speech signal.

BRIEF DESCRIPTION OF THE DRAWINGS

The present invention will now be described by way of example with reference to the accompanying drawings. In the drawings:

FIG. 5 is a table of ambient noise levels suitable for use in tuning the volume setting of a user apparatus;

DETAILED DESCRIPTION OF THE INVENTION

Figure 1:
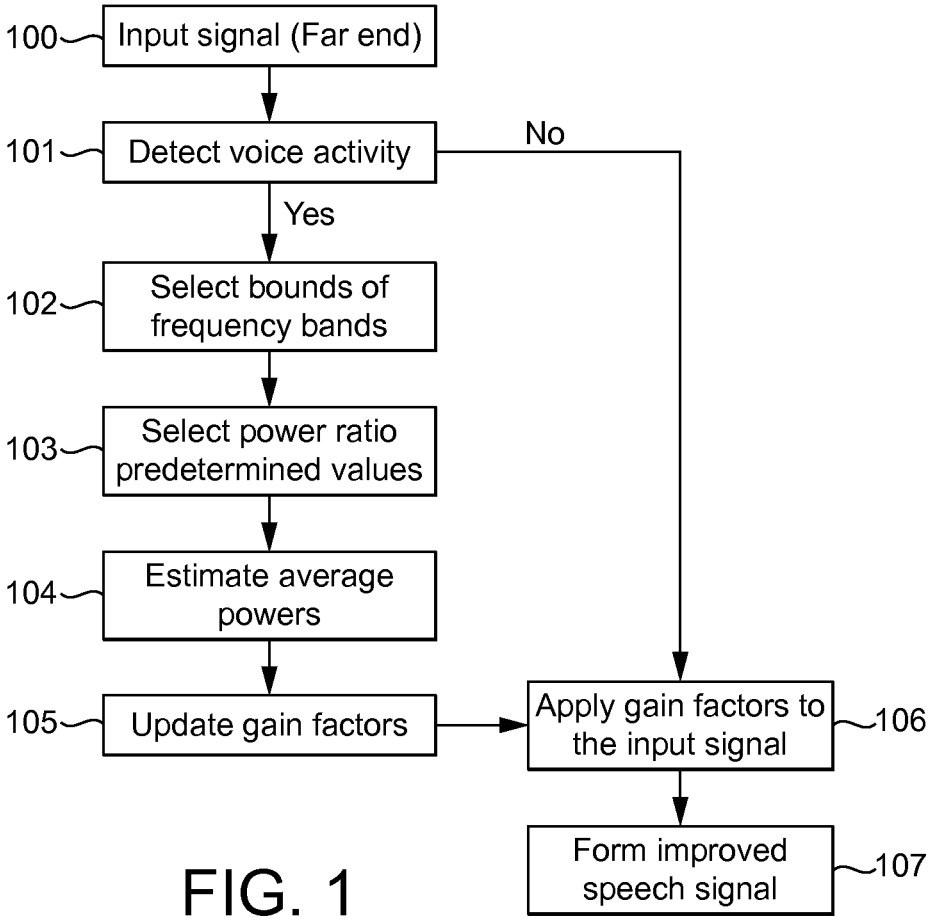
FIG. 1 is a flow diagram of an equalising method according to the present invention.

The following describes three methods performed by an apparatus configured to process and output speech signals. Suitably, the apparatus is part of a user apparatus. Typically, the user apparatus is configured to receive telecommunications signals from another device, and the signals referred to in the following may be such received signals. These signals consequently suffer from the adverse effects of the telecommunications channel, and the ambient noise at both ends of the channel as previously discussed. The described methods are suitable for implementation in real-time.

The first method relates to equalisation of frequency bands of a narrowband signal, the second method relates to extending the bandwidth of a narrowband signal to a wideband signal, and the third method relates to tuning the apparatus in dependence on the near-end ambient noise.

In operation, signals are processed by the apparatus described in discrete temporal parts. The following description refers to processing portions of a signal. These portions may be packets, frames or any other suitable sections of a signal. These portions are generally of the order of a few milliseconds in length.

Equalisation

A preferred embodiment of the equalising method performed by the processing apparatus is described in the following with reference to the flow diagram of FIG. 1.

At the first step 100, a portion of a signal is input to the processing apparatus. In the second step 101, the processing apparatus searches for characteristics indicative of speech in the signal using a voice activity detector. If these characteristics are not detected then the method progresses to step 106, at which gain factors are applied to the portion. The steps 102 to 105 are not performed on that portion of the signal. If characteristics indicative of speech are detected in the portion of the signal using the voice activity detector, then the apparatus proceeds to process that portion according to the remainder of the flow diagram of FIG. 1. In other words, steps 102 to 105 of FIG. 1 relating to updating gain factors are only performed on a portion of a signal if that portion is determined to be voiced (i.e. contain speech).

The voiced portion is preferably processed in three discrete frequency bands. The first frequency band is a middle range of voiced frequencies, the second frequency band is a high range of voiced frequencies, and the third frequency band is a low range of voiced frequencies. The second frequency band encompasses higher frequencies than the first frequency band and is non-overlapping with the first frequency band. Preferably, the second frequency band is contiguous with the first frequency band. The third frequency band encompasses lower frequencies than the first frequency band and is non-overlapping with the first frequency band. Preferably, the third frequency band is contiguous with the first frequency band.

In one embodiment the apparatus processes each voiced portion in frequency bands, each frequency band having predetermined high and low bounds. For example, the predetermined bounds may be selected at manufacture. Typical values for the bounds are 0 Hz to 800 Hz for the low frequency band (third band), 800 Hz to 2000 Hz for the middle frequency band (first band), and 2000 Hz to 4000 Hz for the high frequency band (second band). This embodiment has the associated advantage of being simpler to implement than the following embodiment and hence requiring less processing power. This is advantageous for low power platforms.

In an alternative embodiment, illustrated as step 102 of FIG. 1, the bounds of the frequency bands are dynamically selected in dependence on the pitch characteristics of the speech signal. For example, the apparatus detects whether the source of the speech signal is a male voice or a female voice, and dynamically adjusts the bounds of the frequency bands such that the high frequency band is more likely to include the high frequency consonants of the speech signal and the middle frequency band is more likely to include the lower frequency vowels of the speech signal. This embodiment will result in a better improved quality of speech than the previous embodiment, at the cost of being more computationally complex.

The remaining steps of the flow diagram of FIG. 1 are concerned with modifying the spectral shape of the voiced portion of the speech signal by amplifying or attenuating the signal components in one or more of the frequency bands, so as to improve the perceived quality of the speech signal.

The voiced portion comprises first signal components in the first frequency band, second signal components in the second frequency band, and third signal components in the third frequency band. In one embodiment, a first gain factor is applied to the second signal components in the high frequency band such that the ratio of the average power of the first signal components in the middle frequency band to the average power of the adjusted second signal components in the high frequency band is maintained at a first predetermined value. Also, a second gain factor is applied to the third signal components in the low frequency band such that the ratio of the average power of the adjusted third signal components in the low frequency band to the average power of the first signal components in the middle frequency band is maintained at a second predetermined value. In an alternative embodiment, only a first gain factor as described above is applied to the second signal components in the high frequency band. A second gain factor as described above is not applied to the third signal components in the low frequency band. In another alternative embodiment, only a second gain factor as described above is applied to the third signal components in the low frequency band. A first gain factor as described above is not applied to the second signal components in the high frequency band.

The following description describes the preferable embodiment in which the first gain factor is applied to the second signal components and the second gain factor is applied to the third signal components.

In the first of the remaining steps of the flow diagram, step 103, the apparatus selects values for the first predetermined value and the second predetermined value. The predetermined values may be selected dynamically whilst the speech signal is being processed. Alternatively, the predetermined values may be selected prior to the speech signal being processed by the processing apparatus. For example, the predetermined values may be selected at manufacture. In either case, the predetermined values may be selected by the processing apparatus according to a predefined protocol. Alternatively, the predetermined values may be selected directly or indirectly by a user operating a user apparatus comprising the processing apparatus.

Preferably, the predetermined values are selected dynamically in dependence on one or more criteria so as to inhibit perceptual distortion of the improved speech signal. The predetermined values may be adjusted for each voiced portion, or may be periodically adjusted over a longer time frame.

A first criterion is the ambient noise conditions at the user apparatus comprising the processing apparatus. The processing apparatus decreases the first predetermined value in response to an increase in the ambient noise. This change in the first predetermined value is chosen in order to increase the average power of the frequency components in the high frequency band relative to the average power of the frequency components in the middle frequency band in conditions of increasing ambient noise. This is advantageous because the signal components in the high frequency band representing the high frequency, low power consonants that are ordinarily masked by the ambient noise are amplified such that they are audible over the ambient noise. However, since the first predetermined value limits the average power of the amplified high frequency components relative to the average power of the middle frequency components, over amplification of the high frequency components relative to the middle frequency components is preventable by suitable selection of the first predetermined value. Hence, this method inhibits perceptual distortion of the improved speech signal by avoiding imbalances in the power distribution across the first and second frequency bands.

As the ambient noise decreases, the processing apparatus increases the first predetermined value. This change in the first predetermined value is chosen in order to decrease the average power of the frequency components in the high frequency band relative to the average power of the frequency components in the middle frequency band in conditions of low ambient noise. Amplifying the high frequency components yields artefacts in the amplified signal. In conditions of high ambient noise, such artefacts are substantially masked by the ambient noise. However, in conditions of low ambient noise, these artefacts become audible. Consequently, this method inhibits perceptual distortion of the improved signal caused by artefacts by decreasing the amplification of the high frequency components in low ambient noise conditions.

The processing apparatus decreases the second predetermined value in response to an increase in the ambient noise. This change in the second predetermined value is chosen in order to decrease the average power of the frequency components in the low frequency band relative to the average power of the frequency components in the middle frequency band in conditions of increasing ambient noise. Since voice signals generally have much higher average power in the low frequency band than in the high frequency band, the attenuation in the low frequency band can be selected so as to partially or totally accommodate the amplification in the high frequency band, i.e. such that the average power of the total speech signal across all frequency bands is not significantly increased (or not increased at all if total accommodation is achieved). The gains to be applied to the high and low frequency bands thereby cause the perceived quality of the speech signal to be improved by amplifying the high frequency, low power signal components above the noise masking threshold of the ambient noise—thereby improving the intelligibility of the speech signal—without requiring a higher dynamic range of the overall speech signal.

A second criterion is the volume setting used by the user apparatus outputting the improved speech signal. The processing apparatus decreases the first predetermined value in response to an increase in the volume setting. This change in the first predetermined value is chosen in order to increase the average power of the frequency components in the high frequency band relative to the average power of the frequency components in the middle frequency band when the signal is being outputted from the user apparatus at a loud volume. This is to reflect the fact that the human hearing frequency response becomes flatter the louder the signal. In other words, when the volume of the speech signal is low, the human hearing system is much more sensitive to high frequency speech components than middle frequency speech components; however when the volume of the speech signal is high, the human hearing system is approximately equally sensitive to high frequency speech components as middle frequency speech components. This method inhibits perceptual distortion of the improved speech signal by avoiding imbalances in the perceived loudness of the signal across the first and second frequency bands. Furthermore, since the perceptual loudness of the high frequency speech components is greater than the middle frequency speech components at low volumes, the user does not need to increase the overall volume level much in order to hear the high frequency speech components. Limiting the volume increase avoids unnecessary amplification of the low and middle frequency speech components and hence limits listener discomfort and fatigue.

The processing apparatus decreases the second predetermined value in response to an increase in the volume setting. This change in the second predetermined value is chosen in order to decrease the average power of the frequency components in the low frequency band relative to the average power of the frequency components in the middle frequency band when the signal is being outputted from the user apparatus at loud volume. As explained above, this is to reflect the fact that the human hearing frequency response becomes flatter the louder then signal.

Each predetermined value may be selected dynamically in dependence on the first criterion, the second criterion, or both the first and second criteria.

Suitably, the predetermined values are adjusted in dependence on the first and/or second criteria using one or more look up tables.

In the next step of the flow diagram, step 104, the processing apparatus estimates the average powers of the signal components in the respective frequency bands. The apparatus estimates the average power of the first signal components in the middle frequency band. The apparatus estimates the average power of the second signal components in the high frequency band if a first gain factor is to be selected for application to the second signal components. The apparatus estimates the average power of the third signal components in the low frequency band if a second gain factor is to be selected for application to the third signal components.

Suitably, the power estimates are computed using a first order averaging algorithm. These power estimates can be expressed mathematically as recursions:

$$P_1(n)=\alpha\cdot P_1(n-1)+(1-\alpha)\cdot S_1^2(n)$$

$$P_2(n)=\alpha\cdot P_2(n-1)+(1-\alpha)\cdot S_2^2(n)$$

$$P_3(n)=\alpha\cdot P_3(n-1)+(1-\alpha)\cdot S_3^2(n) \qquad \text{(equation 1)}$$

where:

$P_1(n)$ on the left side of the recursion represents a rolling power estimate for speech components in the middle frequency band of a speech signal, which is determined to be a weighted average of the previous power estimate for that frequency band $P_1(n-1)$ (determined for the previous voiced portion) and the power of the first signal components $S_1(n)$ in that frequency band.

$P_2(n)$ and $P_3(n)$ are similarly defined with respect to the high frequency band and low frequency band respectively. $S_2(n)$ represents the second signal components in the high frequency band of the voiced portion, and $S_3(n)$ represents the third signal components in the low frequency band of the voiced portion.

$\alpha$ is the averaging coefficient, $\alpha=e^{-AverageTime\times fs}$, of the single pole recursion.

$f_s$ is the sampling frequency. For a narrowband signal, $f_s$ is suitably 8 kHz. For a wideband signal, $f_s$ is suitably 16 kHz.

In the next step of the flow diagram, step 105, the processing apparatus updates the first and second gain factors used for the previous iteration of the method. The updating involves selecting a new first gain factor, $gain_1$, and a new second gain factor, $gain_2$. The ratios of the average powers of the relevant frequency bands are defined as follows:

$$ratio_1=P_1(n)/P_2(n)$$

$$ratio_1=P_3(n)/P_1(n) \qquad \text{(equation 2)}$$

In other words, $ratio_1$ is the ratio of the average power of the first signal components in the middle frequency band to the average power of the second signal components in the high frequency band. $ratio_2$ is the ratio of the average power of the third signal components in the low frequency band to the average power of the first signal components in the middle frequency band.

The gain values are selected such that in the improved speech signal $ratio_1$ is equal to the first predetermined value $T_1$, and $ratio_2$ is equal to the second predetermined value $T_2$. Mathematically:

$$gain_1=ratio_1/T_1$$

$$gain_2=T_2/ratio_2 \qquad \text{(equation 3)}$$

Generally, $gain_1$, applied to the high frequency components, is an amplification factor; and $gain_2$, applied to the low frequency components is an attenuation factor. However, $gain_1$ may be an attenuation factor and $gain_2$ may be an amplification factor.

In the next step of the flow diagram, step 106, the processing apparatus applies the first gain factor to the second signal components of the high frequency band so as to form adjusted second signal components. The processing apparatus also applies the second gain factor to the third signal components of the low frequency band so as to form adjusted third signal components.

In the case that voice activity is not detected by the voice activity detector at step 101 for a portion of the signal, the processing apparatus implements step 106 of the method by applying the first and second gain factors used for the previous iteration of the method, i.e. on the previous portion of the signal. The previous first gain factor is applied to the second signal components of the high frequency band so as to form adjusted second signal components. The previous second gain factor is applied to the third signal components of the low frequency band so as to form adjusted third signal components.

In the final step of the flow diagram, step 107, the improved speech signal is formed by combining the first signal components, the adjusted second signal components, and the adjusted third signal components. This improved speech signal is then output from the processing apparatus.

The method described with reference to FIG. 1 provides an adaptive approach towards equalisation. The dynamic equalisation reduces the variation in the broad spectral shape of a speech signal caused by negative effects of the transmission channel and characteristics of the transmitting device at the far end of the transmission channel. The method described achieves adaptive equalisation in the speech signal by adjusting the power of the high and low frequency bands relative to the power of the middle frequency band so as to maintain fixed inter-band power ratios. This method can be used to achieve a desired power distribution across the frequency bands, thereby overcoming the variation problem described above whilst avoiding an unbalanced power distribution perceived as distortion by a listener.

The adaptive dynamic equalisation improves the speech intelligibility and loudness in conditions of high ambient noise. However, it also has the capability of improving speech intelligibility and loudness in conditions of low ambient noise. Preferably, the adaptive dynamic equaliser is tuned using the frequency domain noise dependent volume control approach described below. Alternatively, a different tuning method could be used.

The method described has low computational complexity compared to the known methods previously described. This is particularly advantageous for low power platforms such as Bluetooth.

It is to be understood that the equalisation method described herein is not limited to processing the signal in two or three frequency bands. The method can be generalised to processing the signal in more than three frequency bands. Advantageously, the use of more frequency bands results in a finer frequency resolution. However, this is at the cost of an increase in the computational complexity of the method. Additionally, the number of frequency bands is limited in that the width of each frequency band should not be so fine as to disrupt the detection of the formant structure of the speech signal.

Figure 6:
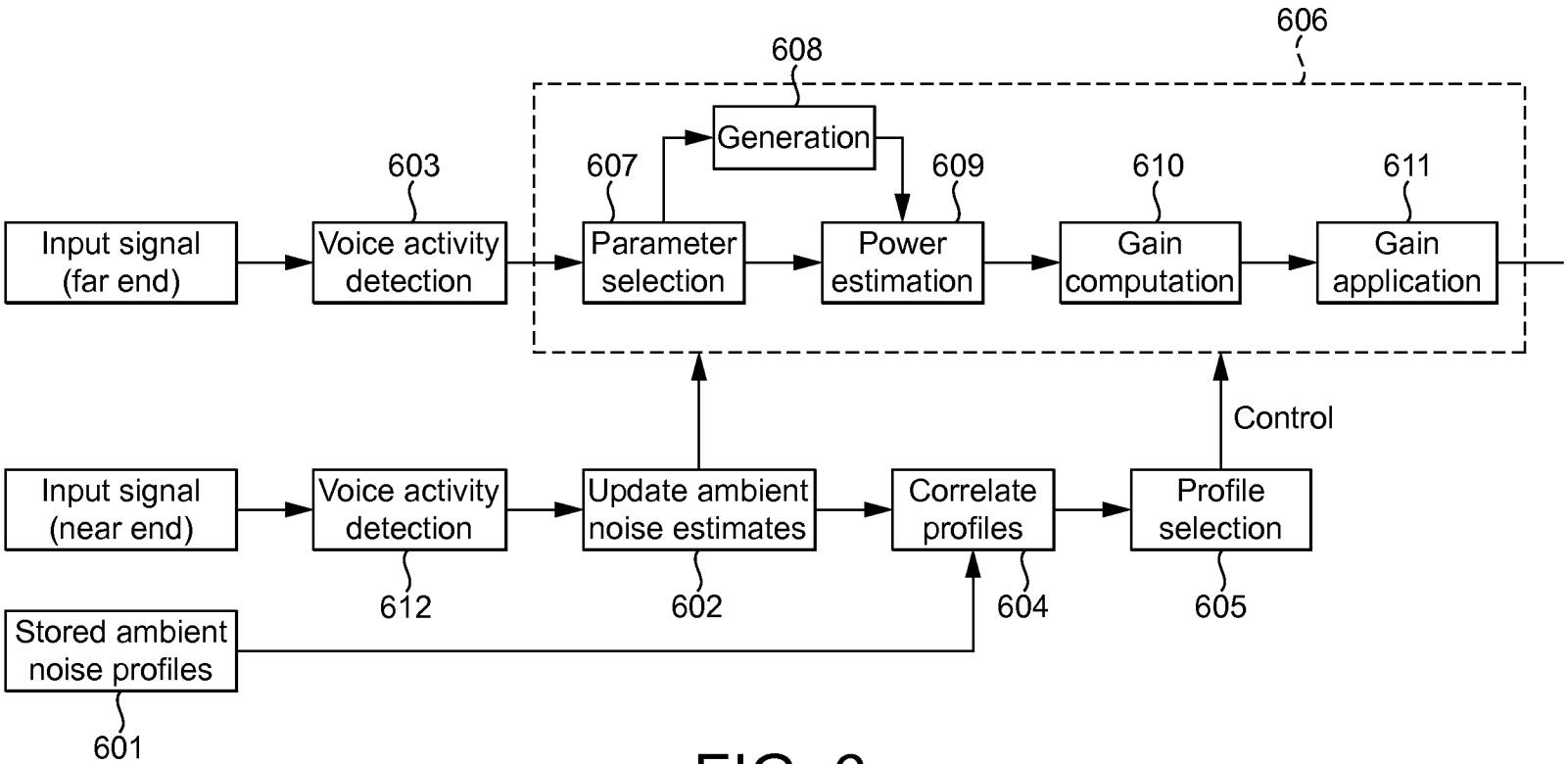
FIG. 6 is a schematic diagram of a processing apparatus according to the present invention.

FIG. 6 illustrates the structure of the modules in a user apparatus suitable for implementing the equalisation method described. Suitably, the voice activity detector 603 is configured to detect characteristics of the speech signal indicative of speech. Suitably, the spectral shape modifier 606 comprises: a parameter selection module 607 configured to select bounds of the frequency bands and the first and second predetermined values; a power estimation module 609 configured to estimate the average powers of the frequency bands; a gain selection module 610 configured to select the first and second gain factors; and a gain application module 611 configured to apply the selected gain factors to the high and low frequency bands.

Bandwidth Extension

Speech signals are truncated from their original wideband form (for example 0 kHz to 8 kHz) to a narrowband form (0.3 kHz to 3.4 kHz) such that they can be transmitted in the available bandwidth of a telephony channel. The absence of speech in frequency bands higher than 3.4 kHz reduces the perceived quality of speech signals. The following describes a method for extending the effective bandwidth of the narrowband signal to a wideband signal.

A preferred embodiment of the bandwidth extension method performed by the processing apparatus is described in the following with reference to the flow diagram of FIG. 2.

At the first step 200, a portion of a signal is input to the processing apparatus. Suitably, this portion includes both a far-end signal and a near-end signal. Far-end refers to the part of the signal received over the telephony channel. Near-end refers to the part of the signal that is used to monitor the surrounding ambient noise, and is typically from a near-end microphone. In the second step 201, the processing apparatus measures the ambient noise at the user apparatus (based on the near-end input). At step 202, the apparatus determines if the measured ambient noise exceeds a threshold value. If the ambient noise does not exceed the threshold value then the remaining steps of the flow diagram are not performed on that portion of the signal, and the original portion of far-end signal is output from the apparatus. The bandwidth of this signal portion has not been extended. The method returns to step 200 and the processing apparatus measures the ambient noise at a time when a subsequent portion of the signal is received. The apparatus may measure the ambient noise at the user apparatus each time a portion of the signal is processed. Alternatively, the ambient noise may be measured periodically over a longer time frame. If the ambient noise is measured as exceeding the threshold value then the processing of that portion of the signal progresses onto step 205 of the flow diagram. The threshold value is such that above the threshold value the ambient noise inhibits perceptual artefacts in the improved signal (output from the user apparatus) caused by the generation of speech components in extended bands. Steps 204 to 211 of FIG. 2 are only performed on a portion of a signal if that portion is received at a time when the ambient noise level is high. The threshold value can be varied, for example in dependence on the type of ambient noise at the user apparatus, using the tuning method described later.

In the equalisation method, the received signal (i.e. the narrowband signal) is processed in three discrete frequency bands. In this bandwidth extension method, the narrowband signal is again treated as three discrete frequency bands with the same properties as described with reference to the equalisation method. The processing apparatus generates a further two discrete frequency bands each encompassing higher frequencies than the narrowband signal. The properties of these additional two bands depend only on the properties of the middle (first) and high (second) frequency bands as described in the equalisation method. For this bandwidth extension method the two generated frequency bands will be referred to as the third frequency band and the fourth frequency band.

The third frequency band encompasses higher frequencies than the second (middle) frequency band and is non-overlapping with the second frequency band. Preferably, the third frequency band is contiguous with the second frequency band. The fourth frequency band encompasses higher frequencies than the third frequency band and is non-overlapping with the third frequency band. Preferably, the fourth frequency band is contiguous with the third frequency band.

In one embodiment the apparatus processes each voiced portion in frequency bands, each frequency band having predetermined high and low bounds. The low, middle and high frequency bands of the narrowband signal may be selected at manufacture as described in the equalisation method. Similarly, the bounds of the extended bands (third frequency band and fourth frequency band) may be predetermined. A typical lower bound of the third frequency band is 3600 Hz. A typical upper bound of the fourth frequency band is 6000 Hz.

In an alternative embodiment, illustrated as step 205 of FIG. 2, the bounds of the frequency bands are dynamically selected as described with reference to step 102 of FIG. 1. Since the bandwidth extension method maps the signal components of the middle and high frequency bands of the narrowband signal to the third and fourth extended bands, the bounds of the third and fourth extended bands are dependent on the bounds of the first (middle) and second (high) frequency bands.

Figure 2:
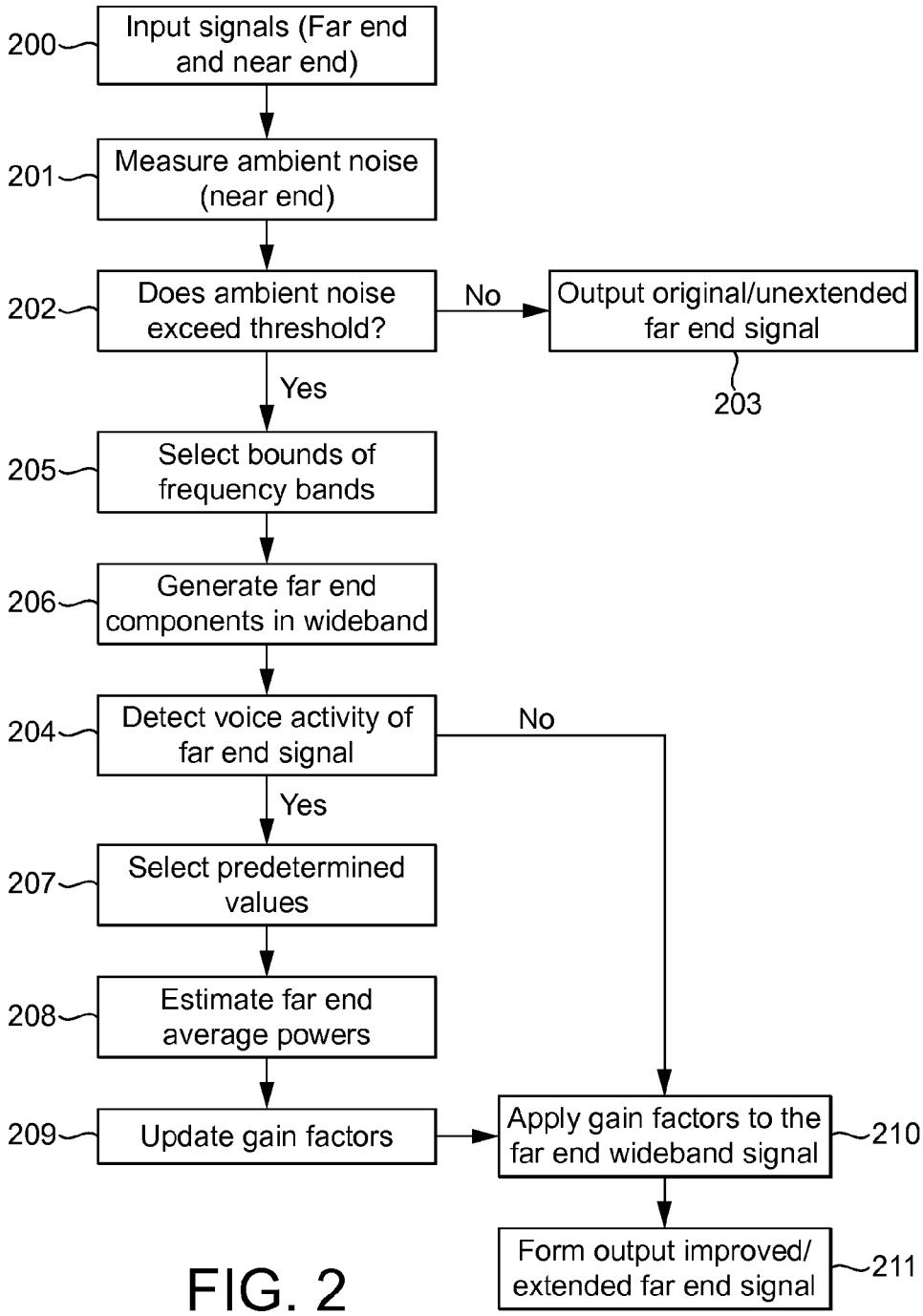
FIG. 2 is a flow diagram of a bandwidth extension method according to the present invention.

The remaining steps of the flow diagram of FIG. 2 are concerned with modifying the spectral shape of the voiced portion of the speech signal by forming speech components in the extended frequency bands, so as to improve the perceived quality of the speech signal by increasing the intelligibility of the speech signal.

In the case that voice activity is not detected, the spectral shape of the portion is still modified by forming components in the extended frequency bands from the original far-end signal. These components are formed in the same way as the speech components in the extended frequency bands described in the following in relation to a voiced signal.

In step 206, the processing apparatus generates speech components in the extended frequency bands. The processing apparatus generates in the third frequency band third speech components matching the first speech components in the first frequency band. The processing apparatus also generates in the fourth frequency band fourth speech components matching the second speech components in the second frequency band.

Gain factors are applied to the components generated in the extended frequency bands so as to shape the power distribution of the outputted signal such that it resembles a model power distribution of the original wideband signal.

In step 204, the processing apparatus searches the far-end input signal for characteristics indicative of speech in the signal using a voice activity detector. The method in respect of this step occurs as described with reference to step 101 of FIG. 1. If the characteristics are not detected then the method progresses to step 210, at which gain factors are applied to the portion. The steps 207 to 209 are not performed on that portion of the signal. If the characteristics indicative of speech are detected in a portion of the far-end signal using the voice activity detector, then the apparatus proceeds to process that portion according to the remainder of the flow diagram of FIG. 2. In other words, the steps 207 to 209 of FIG. 2 relating to updating gain factors are only performed on a portion of a far-end signal if that portion is determined to be voiced (i.e. contain speech).

A first gain factor is applied to the third speech components in the third frequency band such that the ratio of the average power of the adjusted third speech components in the third frequency band to the average power of the first speech components in the first frequency band is maintained at a first predetermined value. A second gain factor is applied to the fourth speech components in the fourth frequency band such that the ratio of the average power of the adjusted fourth speech components to the average power of the adjusted third speech components is a predetermined value. In other words, the ratio of the average power of the adjusted fourth speech components in the fourth frequency band to the average power of the first speech components in the first frequency band is maintained at a second predetermined value. Note that the first and second predetermined values discussed in this bandwidth extension method are distinct from the first and second predetermined values discussed in the equalisation method.

In the first of the remaining steps of the flow diagram, step 207, the apparatus selects values for the first predetermined value and the second predetermined value. The predetermined values may be selected dynamically whilst the speech signal is being processed. Alternatively, the predetermined values may be selected prior to the speech signal being processed by the processing apparatus. For example, the predetermined values may be selected at manufacture. In either case, the predetermined values may be selected by the processing apparatus according to a predefined protocol. Alternatively, the predetermined values may be selected directly or indirectly by a user operating a user apparatus comprising the processing apparatus.

At least one of the first and second predetermined values may be adjusted dynamically in dependence on at least one criterion as explained with reference to the predetermined values of the equalisation method. Suitably, the predetermined values are adjusted in dependence on the first and/or second criteria using one or more look up tables.

In the next step of the flow diagram, step 208, the processing apparatus estimates the average powers of the signal components in the first and second frequency bands of the received narrowband signal, and the average powers of the generated signal components in the third and fourth frequency bands. Suitably, these average powers are determined as described with reference to step 104 of the equalisation method.

In the next step of the flow diagram, step 209, the processing apparatus updates the first and second gain factors used for the previous iteration of the method. The updating involves selecting a new first gain factor, $gain_3$, and a new second gain factor, $gain_4$. The ratios of the average powers of the relevant frequency bands are defined as follows:

$$ratio_3 = P_3(n)/P_1(n)$$

$$ratio_4 = P_4(n)/P_1(n) \qquad \text{(equation 4)}$$

wherein $P_3(n)$ represents the average power of the generated third speech components in the third frequency band, and $P_4(n)$ represents the average power of the generated fourth speech components in the fourth frequency band. In other words, $ratio_3$ is the ratio of the average power of the generated third speech components in the third frequency band to the average power of the first speech components in the first frequency band. $ratio_4$ is the ratio of the average power of the generated fourth speech components in the fourth frequency band to the average power of the first speech components in the first frequency band.

The gain values are selected such that in the improved speech signal $ratio_3$ is equal to the first predetermined value $T_3$, and $ratio_4$ is equal to the second predetermined value $T_4$. Mathematically:

$$gain_3 = T_3/ratio_3$$

$$gain_4 = T_4/ratio_4 \qquad \text{(equation 5)}$$

Generally, $gain_3$, applied to the generated third speech components, is an attenuation factor; and $gain_4$, applied to the generated fourth speech components is an attenuation factor. However, $gain_3$ may be an amplification factor and $gain_4$ may be an amplification factor.

In the next step of the flow diagram, step 210, the processing apparatus applies the first gain factor $gain_3$ to the generated third speech components of the third frequency band so as to form adjusted third speech components. The processing apparatus also applies the second gain factor $gain_4$ to the generated fourth speech components of the fourth frequency band so as to form adjusted fourth speech components.

In the case that voice activity is not detected by the voice activity detector at step 204 for a portion of the signal, the processing apparatus implements step 210 of the method by applying the first and second gain factors used for the previous iteration of the method, i.e. on the previous portion of the signal.

In the final step of the flow diagram, step 211, the improved speech signal is formed by combining the first speech components, the second speech components, the adjusted third speech components, and the adjusted fourth speech components. The improved speech signal also includes the low frequency band of the narrowband signal which was not used in generating the extended frequency bands. This improved speech signal is then output from the processing apparatus.

If the lowest bound of the received narrowband signal is not 0 Hz, then the bandwidth extension as described above can be similarly applied to generate extended low frequency band(s).

The method described with reference to FIG. 2 provides bandwidth extension for a received narrowband signal. This method improves the intelligibility of a received narrowband speech signal in conditions of high ambient noise by artificially adding speech in higher frequency bands. This is effective because those higher frequency bands are often less dominated by the ambient noise, therefore a listener is able to discriminate speech outputted in those frequency bands at ambient noise levels at which they cannot discriminate speech outputted in lower frequency bands. The effective signal to noise ratio (SNR) of the overall fullband signal is significantly improved by adding speech to frequency bands that did not previously contain any speech. An alternative way to improve the intelligibility of speech in conditions of high ambient noise is to increase the power of the speech signal across all frequencies. The bandwidth extension method described herein is preferable to that method because it achieves the desired aim of improving the intelligibility without increasing the average full-band power of the signal, therefore without causing the listener discomfort or listening fatigue.

The use of bandwidth extension to increase the intelligibility of speech in the manner described herein is different to the general use of bandwidth extension to approximate the quality of wideband speech by extrapolating the frequency content of narrowband speech. This means that the computationally less complex method described herein of replicating the speech content of the lower frequency bands in the extended bands is suitable for use. The method described herein does result in artefacts being present in the resulting speech signal. These artefacts are substantially masked by the ambient noise if the ambient noise is sufficiently high. However, in conditions of low ambient noise the bandwidth extension is not performed because in these conditions the artefacts would be audible and hence the perceived quality of the speech signal would not be improved by performing the bandwidth extension.

The bandwidth extension method described herein avoids the problem of over-estimating the power of the extended bands by using two extension bands, and by adjusting the power of each of the extended bands relative to the power of the first (middle) frequency band of the narrowband speech signal. In this way fixed inter-band power ratios are maintained between the two extension bands, and between each of the extension bands and the first frequency band. Consequently, the spectral shape of the wideband speech signal can be adjusted so as to achieve a desired power distribution across the frequency bands.

It is to be understood that the bandwidth extension method described herein is not limited to processing the signal with two extension frequency bands. The method can be generalised to processing the signal using more than two extension frequency bands. Advantageously, the use of more frequency bands results in a finer frequency resolution. However, this is at the cost of an increase in the computational complexity of the method.

Preferably, the bandwidth extension method is tuned using the tuning method described below. In particular, this tuning method is used to determine when the ambient noise conditions are such that the bandwidth extension method should be used, and when the ambient noise conditions are such that the bandwidth extension method should not be used. Alternatively, a different tuning method could be used.

The method described has low computational complexity compared to known methods. This is because the speech components in the lower frequency bands are matched (i.e. replicated) in the extended frequency bands, rather than extrapolated into the extended frequency bands. This is particularly advantageous for low power platforms such as Bluetooth.

FIG. 6 illustrates the structure of the modules in a user apparatus suitable for implementing the bandwidth extension method described. Suitably, the voice activity detector 612 is configured to detect characteristics of the speech signal indicative of speech. Suitably, the ambient noise detector 602 is configured to measure the ambient noise. Suitably, the spectral shape modifier 606 comprises: a parameter selection module 607 configured to select bounds of the frequency bands and the predetermined values; a generation module 608 configured to generate speech components in the extension bands; a power estimation module 609 configured to estimate the average powers of the frequency bands; a gain selection module 610 configured to select the gain factors; and a gain application module 611 configured to apply the selected gain factors to the relevant frequency bands.

Tuning Method

Figure 3:
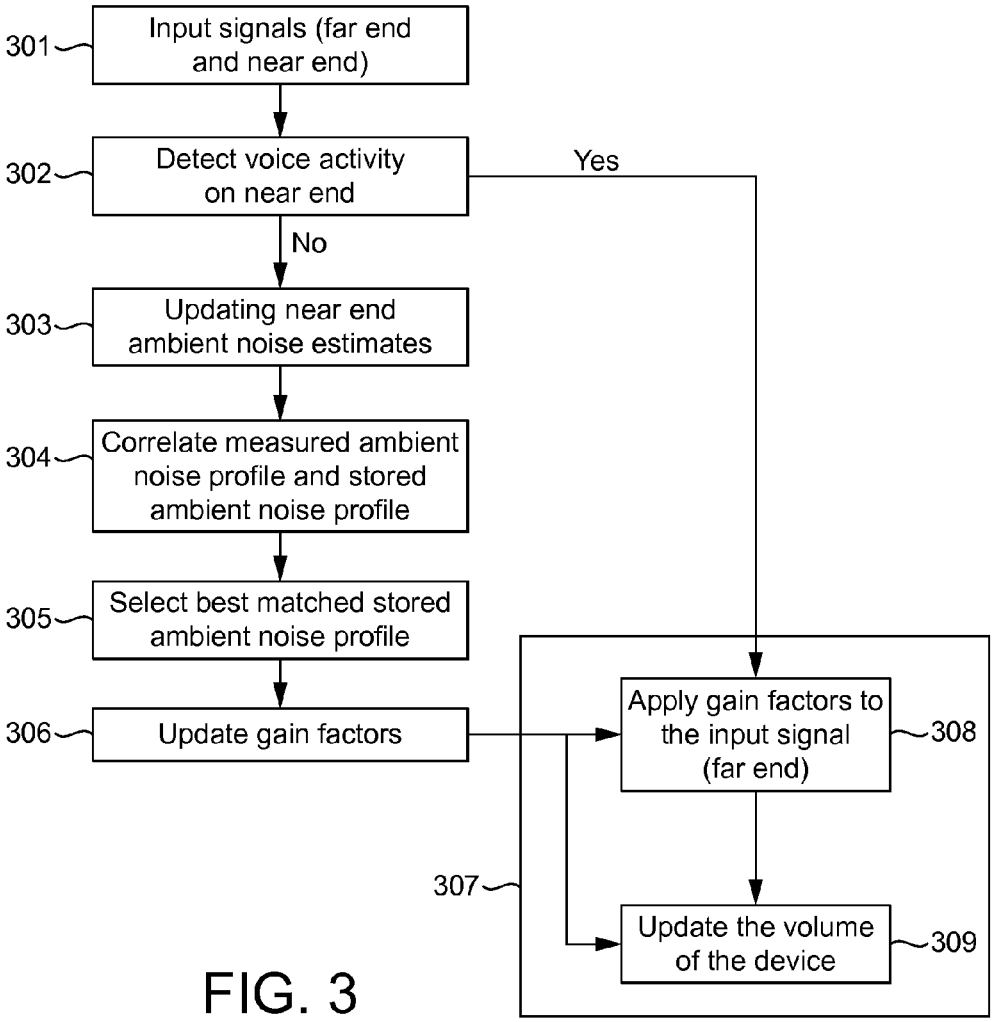
FIG. 3 is a flow diagram of a tuning method according to the present invention.

A preferred embodiment of the tuning method performed by the processing apparatus is described in the following with reference to the flow diagram of FIG. 3. This tuning method addresses the compensation of stationary ambient noise at the near-end user apparatus.

Figure 4:
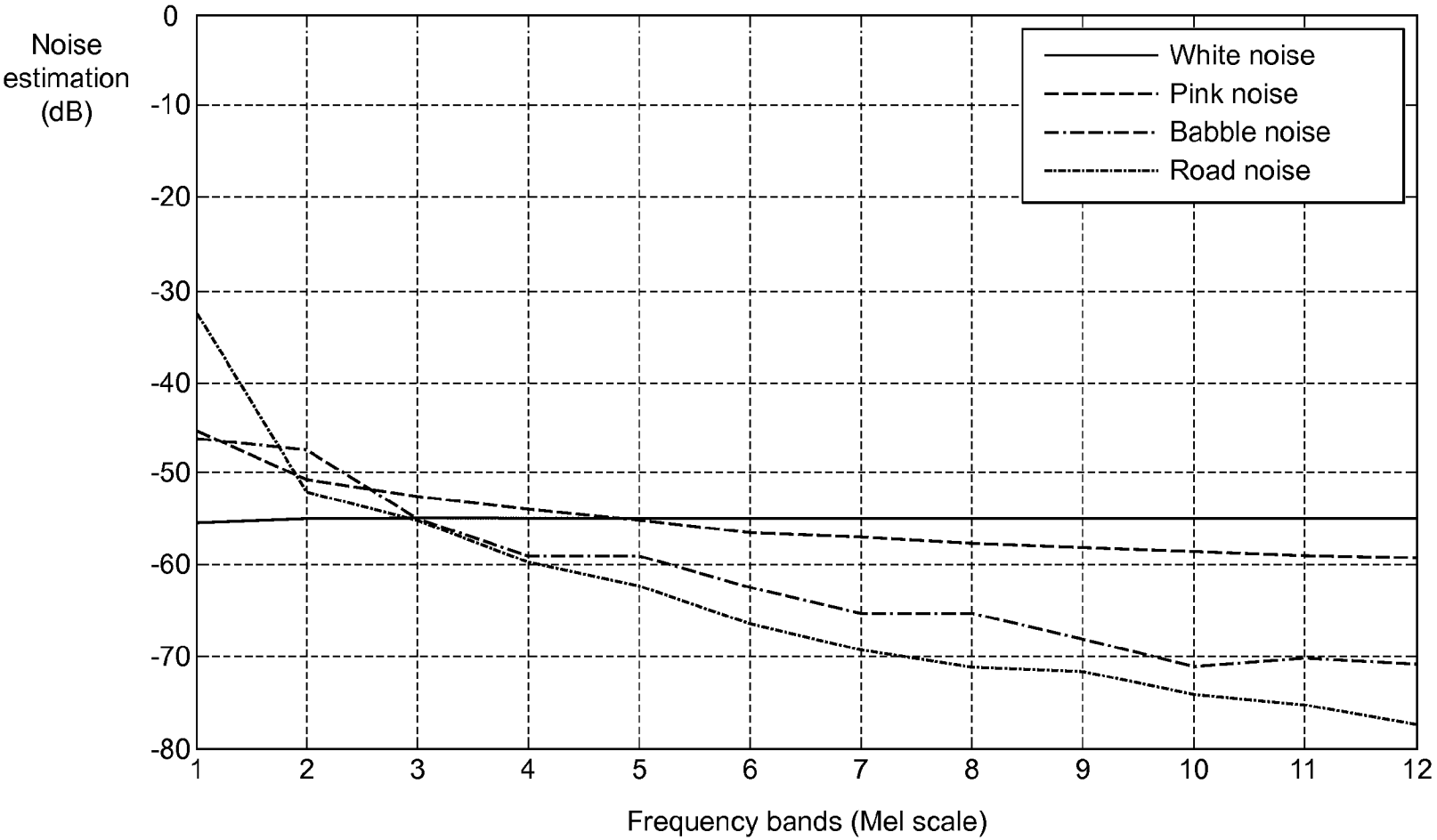
FIG. 4 illustrates example ambient noise profiles.

Predetermined ambient noise profiles are stored in the memory of the apparatus. Each ambient noise profile indicates a model power distribution of a respective ambient noise type as a function of frequency. Examples of ambient noise types include white noise, pink noise, babble noise and road noise. FIG. 4 illustrates example stored profiles for these example ambient noise types. The profiles are plotted using the Mel scale. Suitably, these model profiles are predicted profiles for each noise type based on known or measured characteristics of the noise types. Suitably, these profiles are determined independent of the particular user apparatus and stored on the user apparatus at manufacture.

At the first step, 301, a portion of a signal is input to the processing apparatus. Suitably, this portion includes both far-end received signal components and near-end signal components. Far-end refers to the part of the signal received over the telephony channel. Near-end refers to the part of the signal that is used to monitor the surrounding ambient noise, and is typically picked up by a near-end microphone. In the second step 302, the processing apparatus searches for characteristics indicative of speech in the near-end signal part of the portion. The method in respect of this step occurs as described with reference to step 101 of FIG. 1. The remaining method steps are different depending on whether the characteristics indicative of speech are detected.

If the characteristics indicative of speech are detected in the near-end signal part of the portion, the apparatus does not measure the ambient noise profile at the user apparatus. Instead, the method progresses to step 307 at which gain factors are applied to the far-end signal part of the portion. The steps 303 to 306 are not performed on that portion of the signal.

If the characteristics indicative of speech are not detected, then the method progresses to step 303. At step 303 the apparatus measures the ambient noise profile at the user apparatus. This measurement involves determining estimates of the noise power in a plurality of frequency regions. Preferably the frequency regions are non-overlapping. The estimates are obtained by a single pole recursion in the microphone signal.

The recursion is stopped in the presence of a portion of voiced signal. This is important because a voiced signal disrupts the measurement of the power of the ambient noise.

At step 304, the apparatus correlates the measured ambient noise profile with each of the stored ambient noise profiles in order to determine which stored ambient noise profile best matches the measured ambient noise profile. This involves correlating each measured noise estimate of a frequency band against the stored noise estimate of the same frequency band. Suitably, the apparatus performs the correlation in accordance with the following equation:

$$i^* = \arg\min_i \left( \operatorname{var}_k (\log N(k) - \log N_{si}(k)) \right) \quad \text{(equation 6)}$$

wherein N(k) is the measured ambient noise profile; $N_{si}(k)$ is a model ambient noise profile, the index i denoting the noise profile index (i.e. the noise type); and k denotes a group of fast Fourier transformed points representing a frequency region.

Equation 6 involves, for each noise type, calculating the variance of the difference between the measured ambient noise profile and the stored ambient noise profile for that noise type. Specifically, for each stored ambient noise type, the variance of the difference between the log of the average power of the measured ambient noise and the log of the average power of the stored ambient noise across the frequency regions (denoted by k) is determined. This results in one variance determination for each ambient noise profile. The ambient noise type having the smallest variance is selected as the ambient noise type with which the measured ambient noise is best matched. In other words, the measured ambient noise profile is most highly correlated with the selected stored ambient noise profile for that noise type. The variance is calculated so as to avoid the absolute level difference between the measured and stored ambient noise profiles affecting the selection of the stored ambient noise profile.

At step 305, the stored ambient noise profile with which the measured ambient noise profile is most highly correlated is selected.

The determination of the ambient noise type best correlated with the measured ambient noise can be used in a number of applications. For example, it can be used to shape the speech signal, control the equalisation and bandwidth extension methods previously discussed, and also to control the volume setting of the user apparatus.

At step 306, the apparatus selects a gain factor for each frequency region, k. These gain factors may be represented by frequency-dependent gain factor $G_{NDVC}$. $G_{NDVC}$ is determined in dependence on the selected stored ambient noise profile. The processing apparatus may apply $G_{NDVC}$ directly to the speech signal, and/or may use $G_{NDVC}$ in controlling other applications. Suitably, $G_{NDVC}$ is determined according to the following equation:

$$G_{NDVC}(k)=\min(\max(\sqrt{N(k)/N_s(k)},1),G_{max}) \quad \text{(equation 7)}$$

According to equation 7, if for the frequency region k the average power of the measured ambient noise profile N(k) is less than the average power of the selected stored ambient noise profile $N_s(k)$, the gain factor $G_{NDVC}$ is 1.

According to equation 7, if for the frequency region k the square root of the ratio of the average power of the measured ambient noise profile N(k) to the average power of the selected stored ambient noise profile $N_s(k)$ is greater than $G_{MAX}$, the gain factor $G_{NDVC}$ is $G_{MAX}$.

According to equation 7, if for the frequency region k the square root of the ratio of the average power of the measured ambient noise profile N(k) to the average power of the selected stored ambient noise profile $N_s(k)$ is less than $G_{MAX}$, the gain factor $G_{NDVC}$ is the square root of the ratio of N(k) to $N_s(k)$.

At step 307 the speech signal is manipulated in dependence on which of the stored ambient noise profiles is selected. This manipulation involves at least one of a number of processes. FIG. 3 illustrates two of these processes: applying gain factors to the far-end signal, and controlling the volume setting of the user apparatus. The processes illustrated in FIG. 3 are examples of the manipulations that could be applied to the signal.

A first example manipulation is the application of the frequency dependent gain $G_{NDVC}$ directly to the far-end signal input to the processing apparatus at step 301. This is illustrated as step 308 on FIG. 3. If the near-end signal part of the portion is determined to contain speech at step 302 then the gain factors determined in step 306 for the most recent non-speech (i.e. noise only) portion are applied to the speech components in the far-end signal part of the current portion, so as to form an improved signal comprising the adjusted speech components. In other words, the most recently measured noise ambient profile is used to generate the gain factors to be applied to the current portion of the signal. If the near-end signal part of the portion is determined to contain only noise at step 302, then the gain factors determined in step 306 for that noise-only portion are applied to the speech components of the far end signal part of the current portion at step 308.

When $G_{NDVC}$ is 1 a gain factor of 1 is applied to that frequency band of the signal. In other words that frequency band is not amplified or attenuated. This reflects the fact that the ambient noise levels have been determined to be low in that frequency band and hence the frequency band does not need to be amplified or attenuated in order that the listener can adequately hear the speech. $G_{MAX}$ is a cap on the maximum gain that can be applied to the signal. The value of $G_{MAX}$ is selected so as to prevent a gain being applied to the signal that causes the signal to be at a loudness level that is uncomfortable or damaging to the human hearing system. Such a high gain would otherwise be selected in conditions of sufficiently high ambient noise.

A second example manipulation also applies the frequency dependent gain $G_{NDVC}$ directly to the far-end signal input to the processing apparatus at step 301. However, in this second example manipulation, the gain factor $G_{NDVC}$ is further used to control the volume setting used by the user apparatus in outputting the improved speech signal. This is illustrated as steps 308 and 309 in FIG. 3.

As an alternative to equation 7, $G_{NDVC}$ may be defined differently to in equation 7. For example, $G_{NDVC}$ may be determined according to the following equation:

$$G_{NDVC}(k)=\sqrt{N(k)/N_s(k)} \quad \text{(equation 8)}$$

Equation 8 differs from equation 7 in that $G_{NDVC}(k)$ is not bounded by 1 and $G_{max}$. Using equation 8, a plurality of gain factors $G_{NDVC}(k)$, each at a different frequency region k are determined.

The overall gain $G_{NDVC}$ is applied to the far-end signal in two stages: a digital stage; and an analogue stage. Mathematically:

$$G_{NDVC}(k)=G_{ANALOGUE}*G_{DIGITAL}(k) \quad \text{(equation 9)}$$

where $G_{ANALOGUE}$ is the volume setting based on the average of $G_{NDVC}(k)$; and $G_{DIGITAL}(k)$ is the residual gain to be applied digitally.

This second example manipulation distributes the gain optimally between the digital and analogue stages thereby overcoming problems associated with very small and very large $G_{NDVC}(k)$ values. For example, when a very large $G_{NDVC}(k)$ is determined, the digital stage may not have sufficient numerical range to accommodate it (i.e. saturation might occur). In this case, the volume setting at the analogue stage is increased (step 309). To counterbalance this increase in the volume setting, the gain in the digital stage (step 308) is reduced. The degree to which the volume setting is increased and the digital gain is reduced is selected such that the digital stage is able to accommodate the digital gain without saturation occurring. Conversely, when a very small $G_{NDVC}(k)$ is determined, the digital gain may be so small (for example approaching the quantization floor) that the signal quality would be reduced. In this case, the volume setting at the analogue stage is decreased (step 309). To counterbalance this decrease in the volume setting, the gain in the digital stage (step 308) is increased. The degree to which the volume setting is decreased and the digital gain is increased is selected such that the signal remains at a good numerical range in the digital stage.

The average of the gain factors $G_{DIGITALC}(k)$ is determined, and that average compared to two predetermined values. The first predetermined value is an upper threshold, and the second a lower threshold. The volume setting used by the user apparatus in outputting the improved speech signal is then adjusted in dependence on the result of the comparison. Specifically, if the average goes up relative to the first predetermined value then the volume is incremented, and the digital gain is decremented to counterbalance the volume gain. If the average goes down relative to the second value then the volume is decremented, and the digital gain is incremented to counterbalance the decrease in the volume. The upper and lower thresholds are used to create a tolerance zone. As an alternative to using upper and lower thresholds, a single threshold could be used. If the average goes up relative to the threshold then the volume is incremented. If the average goes down relative to the threshold then the volume is decremented.

Suitably, the first and second predetermined values are pre-tuned according to the user apparatus. For example, if the volume setting of the user apparatus reacts slowly then a large tolerance zone is used.

A third example manipulation is using the selected stored ambient noise profile to tune the adaptive equalisation method previously described. Specifically, $G_{NDVC}$ may be used in selecting the target ratio of the average power of the signal components in the middle frequency band to the average power of the signal components in the high frequency band (i.e. the first predetermined value). Similarly, $G_{NDVC}$ may be used in selecting the target ratio of the average power of the signal components in the low frequency band to the average power of the signal components in the middle frequency band (i.e. the second predetermined value). In this third example manipulation, the average of $G_{NDVC}(k)$ is used to change the volume setting as described in relation to the second example manipulation. This has the effect of achieving dynamic tuning of the equalisation method if the equalisation method is configured to adjust the first and second predetermined values ($T_1$ and $T_2$) of the equalisation method in dependence on the volume setting (as described in the second criterion of the equalisation method).

A fourth example manipulation of the speech signal, at step 307, involves the tuning of the bandwidth extension method. For example, the selected stored ambient noise profile may be used in order to determine the threshold value described with reference to step 202 of FIG. 2. This is the threshold value to which the ambient noise is compared. The bandwidth extension is only performed if the ambient noise exceeds the threshold value. The threshold value may be determined according to:

$$\text{sum}_k(\log[N(k)]-\log[N_s(k)])<0 \qquad \text{(equation 10)}$$

The expression in equation 10 is summed over the frequency domain. Alternatively, the expression may be averaged over the frequency domain. If the expression of equation 10 is true, the user apparatus is considered to be at a location of low ambient noise, and the remaining steps of the bandwidth extension method are not carried out.

However if:

$$\text{sum}_k(\log[N_S(k)]-\log[N(k)])<0 \qquad \text{(equation 11)}$$

then the user apparatus is considered to be at a location of sufficiently high ambient noise that the remaining steps of the bandwidth extension method are to be carried out. As in equation 10, the expression in equation 11 is summed over the frequency domain. Alternatively, the expression may be averaged over the frequency domain.

Comparing the measured ambient noise profile against the selected ambient noise profile allows a single threshold condition to be used. This is preferable to using multiple threshold conditions for different frequency regions because it is less computationally complex. Suitably, the same threshold condition can be applied whichever stored ambient noise profile is selected.

If the bandwidth extension is to be carried out then a gain factor is selected in dependence on the selected stored ambient noise profile. In this fourth example manipulation, the average of $G_{NDVC}(k)$ is used to change the volume setting as described in relation to the second example manipulation. This has the effect of achieving dynamic tuning of the bandwidth extension method if the bandwidth extension method is configured to adjust the first and second predetermined values ($T_3$ and $T_4$) of the bandwidth extension method in dependence on the volume setting (in the same manner as described in relation to the second criterion of the equalisation method).

The tuning method described uses the determined ambient noise type to manipulate a speech signal such that the perceived quality of that speech signal as determined by a listener is improved. The method described has low computational complexity. It is therefore particularly advantageous for low power platforms such as Bluetooth.

FIG. 6 illustrates the structure of the modules in a user apparatus suitable for implementing the tuning method described. Suitably, the store 601 is configured to store the ambient noise profiles; the voice activity detector 612 is configured to detect characteristics of the near-end speech signal indicative of speech, the ambient noise estimator 602 is configured to measure the ambient noise profile at the user apparatus; the correlation module 604 is configured to correlate the measured ambient noise profile with the stored ambient noise profiles; and the profile selection module 605 is configured to select the stored ambient noise profile with which the measured ambient noise profile is most highly correlated. The profile selection is then used to control the spectral shape modifier 606.

Suitably, the tuning method described herein processes portions of the far-end signal in frequency bands each encompassing a smaller range of frequencies than the frequency bands used in the equalisation method and bandwidth extension method. Suitably, more than 10 frequency bands are used in the tuning method.

Figure 7:
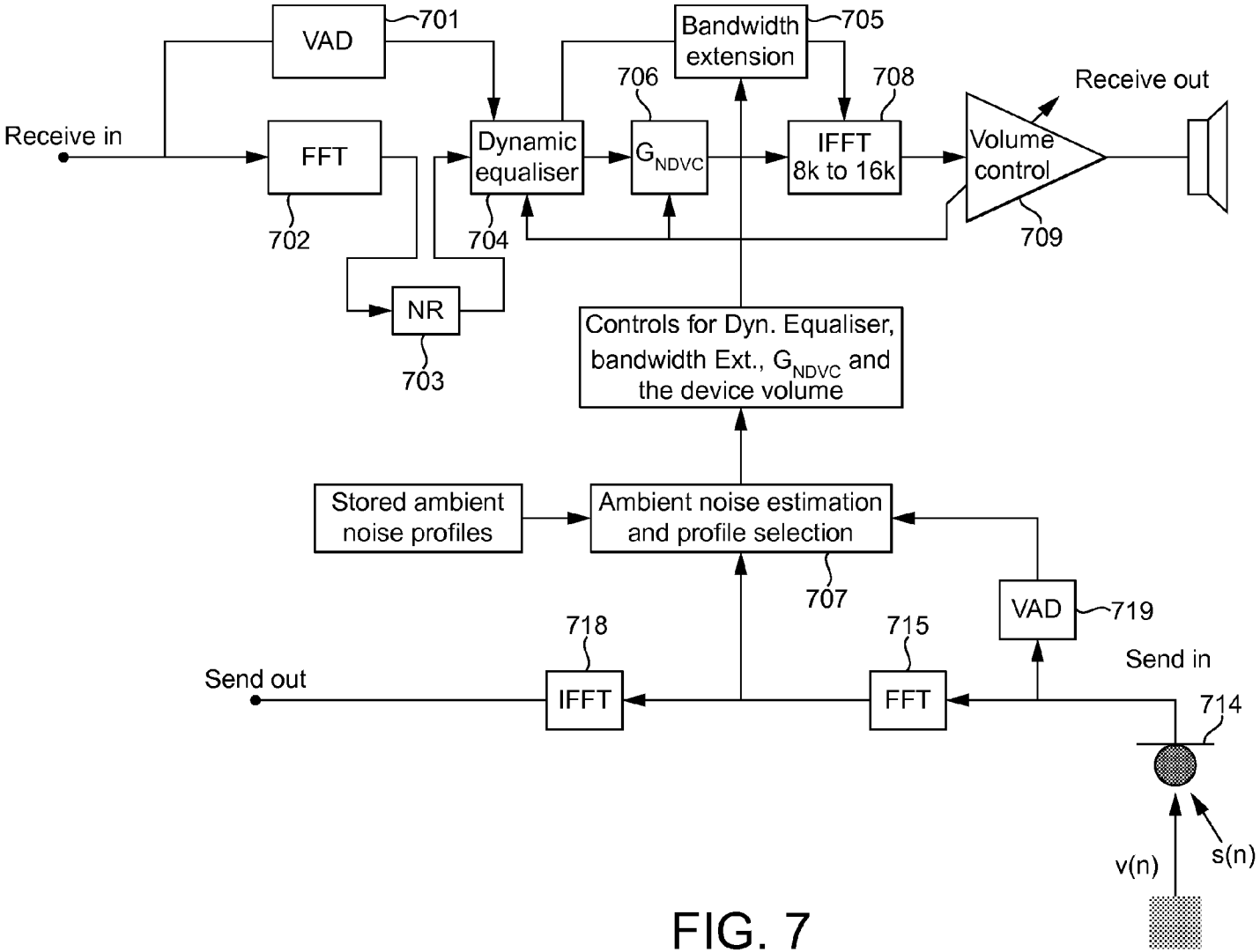
FIG. 7 is a schematic diagram of a telecommunications apparatus according to the present invention.

FIG. 7 is a simplified schematic diagram of a telecommunications apparatus suitable for implementing the methods described herein. Both the receive path and transmit path are shown. On entering the receive path of the user apparatus, the received signal passes through a voice activity detector (VAD) 701. It then undergoes a fast fourier transform (FFT) at 702, following which it passes through a module 703 in which a noise reduction algorithm is applied to it. This may, for example, be a one-microphone based noise reduction algorithm. The adaptive equalisation method is carried out at block 704 and the bandwidth extension method at block 705. The ambient noise is compensated for at block 706 in dependence on an ambient noise estimate carried out at block 707. The signal then undergoes an inverse fast fourier transform (IFFT) at block 708 where it is modulated from 8 kHz up to 16 kHz. The volume of the signal is controlled at block 709, following which the signal is output from the user apparatus.

The transmit path will now be described. The user's voice signal and the ambient noise are input to the microphone 714 and fast fourier transformed at block 715. The signal is subjected to an inverse fast fourier transform (IFFT) at block 718. At block 719 the near-end microphone signal is measured for voice activity. If speech is detected then the ambient noise estimation and profile matching at block 707 are not performed. The speech signal may be processed further before being transmitted.

FIGS. 6 and 7 are schematic diagrams of the apparatus described herein. The method described does not have to be implemented at the dedicated blocks depicted in the figures. The functionality of each block could be carried out by another one of the blocks described or using other apparatus. For example, the method described herein could be implemented partially or entirely in software.

The methods described are useful for speech processing techniques implemented in wireless voice or VoIP communications. The methods are particularly useful for handset and headset applications, and products operating low-power platforms such as some Bluetooth and Wi-Fi products.

The applicant draws attention to the fact that the present invention may include any feature or combination of features disclosed herein either implicitly or explicitly or any generalisation thereof, without limitation to the scope of any of the present claims. In view of the foregoing description it will be evident to a person skilled in the art that various modifications may be made within the scope of the invention.

The invention claimed is:

1. A method of improving the perceived quality of a narrowband speech signal truncated from a wideband speech signal, the narrowband speech signal comprising first speech components in a first frequency band and second speech components in a second frequency band, the method comprising:

generating in a third frequency band third speech components matching the first speech components, and generating in a fourth frequency band fourth speech components matching the second speech components; and applying a first gain factor to the third speech components to generate adjusted third speech components, and applying a second gain factor to the fourth speech components to generate adjusted fourth speech components, the gain factors being selected such that the ratios of the average powers of the adjusted third and fourth speech components to the average power of the first speech components are predetermined values, so as to form an improved speech signal comprising the first speech components, the second speech components, the adjusted third speech components and the adjusted fourth speech components.

2. A method as claimed in claim 1, further comprising prior to the generating step:

measuring the ambient noise; and performing the generating and applying steps only if the ambient noise exceeds a threshold value, the threshold value being such that above the threshold value the ambient noise inhibits perceptual artefacts of the improved speech signal.

3. A method as claimed in claim 1, wherein the first and second frequency bands are non-overlapping with each other, and the second frequency band encompasses higher frequencies than the first frequency band.

4. A method as claimed in claim 3, wherein the third and fourth frequency bands are non-overlapping with each other and each of the third and fourth frequency bands is non-overlapping with the first frequency band and non-overlapping with the second frequency band.

5. A method as claimed in claim 4, wherein the third frequency band encompasses higher frequencies than the second frequency band, and the fourth frequency band encompasses higher frequencies than the third frequency band.

6. A method as claimed in claim 1, further comprising dynamically adjusting the bounds of each frequency band in dependence on the pitch characteristics of the speech signal.

7. A method as claimed in claim 1, wherein the ratio of the average power of the adjusted third speech components to the average power of the first speech components is a first predetermined value of the predetermined values, and the average power of the adjusted fourth speech components to the average power of the first speech components is a second predetermined value of the predetermined values, the method comprising dynamically adjusting at least one of the first and second predetermined values in dependence on one or more criteria.

8. A method as claimed in claim 7, wherein a first criterion of the one or more criteria is the ambient noise, comprising increasing the first predetermined value in response to an increase in the ambient noise.

9. A method as claimed in claim 7, wherein a first criterion of the one or more criteria is the ambient noise, comprising increasing the second predetermined value in response to an increase in the ambient noise.

10. A method as claimed in claim 7, further comprising outputting the improved speech signal via a user apparatus, wherein a second criterion of the one or more criteria is the volume setting used by the apparatus in outputting the improved speech signal, the method comprising increasing the first predetermined value in response to an increase in the volume setting.

11. A method as claimed in claim 7, further comprising outputting the improved speech signal via a user apparatus, wherein a second criterion of the one or more criteria is the volume setting used by the apparatus in outputting the improved speech signal, the method comprising increasing the second predetermined value in response to an increase in the volume setting.

12. A method as claimed in claim 7, comprising periodically adjusting the first predetermined value in dependence on the one or more criteria.

13. A method as claimed in claim 7, comprising periodically adjusting the second predetermined value in dependence on the one or more criteria.

14. A method as claimed in claim 1, wherein the first gain factor is an attenuation factor.

15. A method as claimed in claim 1, wherein the second gain factor is an attenuation factor.

16. An apparatus configured to improve the perceived quality of a narrowband speech signal truncated from a wideband speech signal, the narrowband speech signal comprising first speech components in a first frequency band and second speech components in a second frequency band, the apparatus comprising:

a generation module configured to generate in a third frequency band third speech components matching the first speech components, and generate in a fourth frequency band fourth speech components matching the second speech components; and an application module configured to apply a first gain factor to the third speech components to generate adjusted third speech components, and apply a second gain factor to the fourth speech components to generate adjusted fourth speech components, the application module further configured to select the gain factors such that the ratios of the average powers of the adjusted third and fourth speech components to the average power of the first speech components would be predetermined values, so as to form an improved speech signal comprising the first speech components, the second speech components, the adjusted third speech components and the adjusted fourth speech components.

17. An apparatus as claimed in claim 16, further comprising a noise detector configured to measure the ambient noise, wherein the generation module and the application module are configured to perform their respective generating and applying functions only if the noise detector measures the ambient noise to exceed a threshold value, the threshold value being such that above the threshold value the ambient noise inhibits perceptual artefacts of the improved speech signal.

* * * * *

UNITED STATES PATENT AND TRADEMARK OFFICE

CERTIFICATE OF CORRECTION

PATENT NO. : 8,489,393 B2
APPLICATION NO. : 12/623896
DATED : July 16, 2013
INVENTOR(S) : Rogerio Guedes Alves et al.

It is certified that error appears in the above-identified patent and that said Letters Patent is hereby corrected as shown below:

On the Title Page, in Item (75), under "Inventors", in Column 1, Line 2, delete "Kuan-chieh Yen," and insert -- Kuan-Chieh Yen, --, therefor.

In the Specification

In Column 8, Line 17, in Equation 2, delete "$\text{ratio}_1 = P_3(n)/P_1(n)$" and insert -- $\text{ratio}_2 = P_3(n)/P_1(n)$ --, therefor.

Signed and Sealed this
Twentieth Day of May, 2014

Michelle K. Lee

Michelle K. Lee
*Deputy Director of the United States Patent and Trademark Office*